United States Patent [19]

Peters et al.

[11] Patent Number: 4,483,398

[45] Date of Patent: Nov. 20, 1984

[54] IN-SITU RETORTING OF OIL SHALE

[75] Inventors: Greg G. Peters, Spring; Robert C. West, Houston, both of Tex.

[73] Assignee: Exxon Production Research Co., Houston, Tex.

[21] Appl. No.: 457,833

[22] Filed: Jan. 14, 1983

[51] Int. Cl.[3] ..... E21B 43/247

[52] U.S. Cl. ..... 166/259; 166/261; 166/245

[58] Field of Search ..... 166/257, 256, 259, 261, 166/245; 299/2, 11

[56] References Cited

U.S. PATENT DOCUMENTS

| | | | |
|---|---|---|---|
| 2,718,263 | 9/1955 | Heilman | 166/260 |
| 4,005,752 | 2/1977 | Cha | 166/260 |
| 4,026,360 | 5/1977 | Drinkard | 166/272 |
| 4,093,310 | 6/1978 | Terry | 299/2 |
| 4,109,718 | 8/1978 | Burton | 166/256 |
| 4,120,355 | 10/1978 | Knepper | 166/259 |
| 4,219,237 | 8/1980 | Sigemore | 299/2 |
| 4,399,866 | 8/1983 | Dearth | 166/245 |

*Primary Examiner*—George A. Suchfield
*Assistant Examiner*—Michael Starinsky
*Attorney, Agent, or Firm*—Alfred A. Equitz

[57] ABSTRACT

Fluid, such as liquid water, is injected into the rock surrounding an in situ oil shale retort at sufficient pressure and flow rate so that the injected fluid flows toward the retort to block the path of hot liquid and gaseous kerogen decomposition products escaping from the retort and to return heat to the retort. The successful conduct of an oil shale retorting operation usually requires that the retort temperature be maintained at a temperature sufficient to decompose efficiently the kerogen contained in the oil shale. By reducing the heat loss from an active retort, the amount of energy required to maintain a desired temperature therein is reduced. The fluid injection method also maintains pressure in an in-situ oil shale retort, allowing in-situ oil shale retorting to be efficiently conducted at a desired pressure. The method also reduces the danger to mineworkers who may be engaged in adjacent mining operations due to the escape of hazardous gases from an active retort. The method allows a series of sequential in-situ oil shale retorts in an oil shale formation to be placed more closely together than previously practical by reducing hot fluid leakage from each active retort to one or more abandoned retorts adjacent thereto, thus improving the recovery factor from the formation. The method also minimizes contamination of the formation surrounding an active in-situ retort due to hazardous chemicals which may be contained in the kerogen decomposition products leaking from the retort.

3 Claims, 2 Drawing Figures

FIG. 1
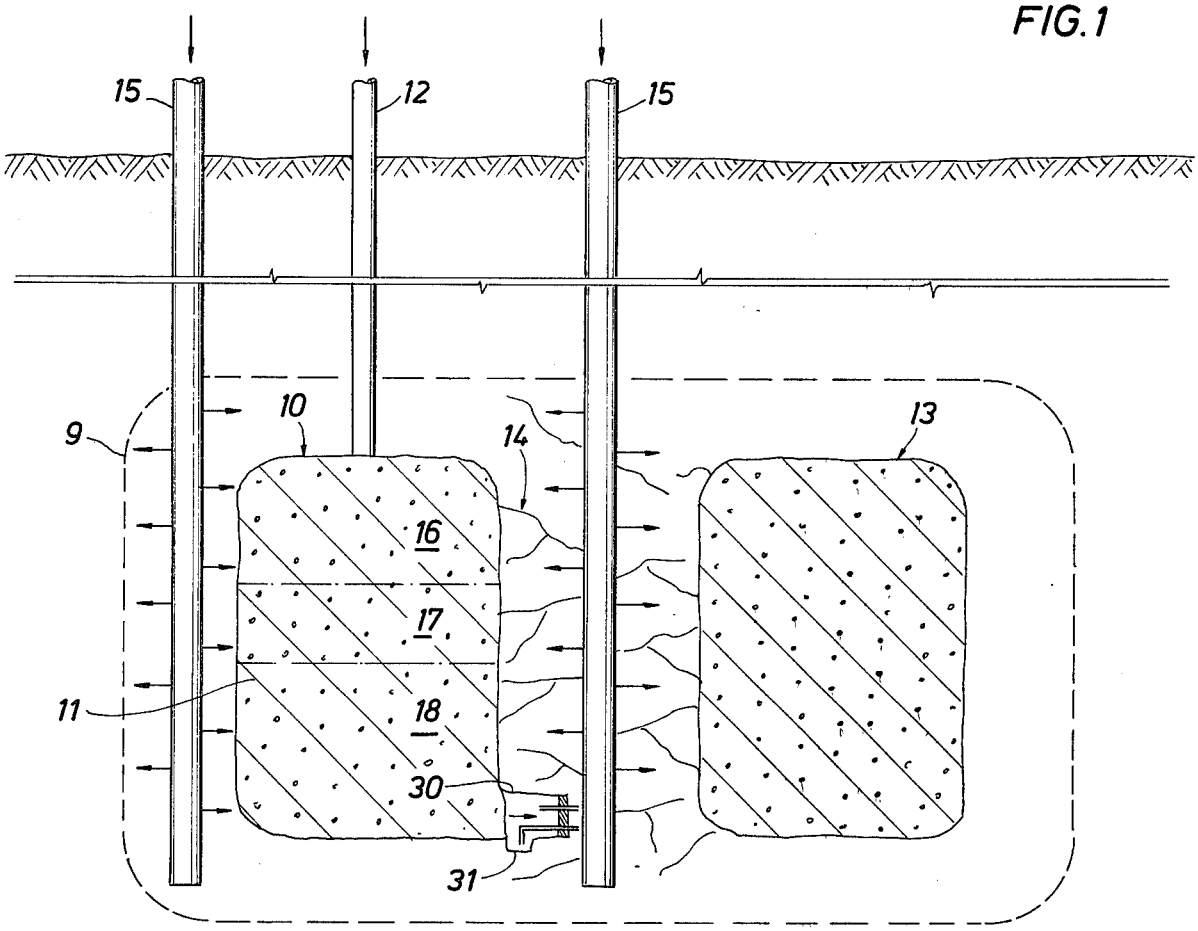
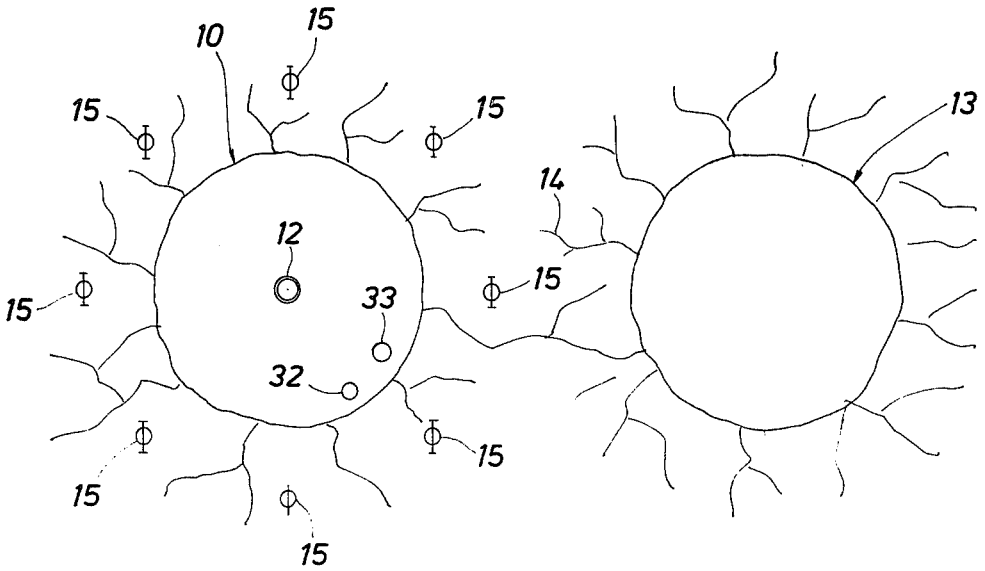
FIG. 2

IN-SITU RETORTING OF OIL SHALE

BACKGROUND OF THE INVENTION

1. Field of the Invention

This invention relates generally to the in-situ retorting of oil shale. Fluid is injected into the rock surrounding an active in-situ oil shale retort in a manner so that the injected fluid flows toward the active retort to contain high temperature gases and liquids produced during the retorting process, thus reducing heat losses and the flow of contaminants from the retort and maintaining pressure in the retort.

2. Description of the Prior Art

Oil shale may be defined as any fine-grained, compact, sedimentary rock containing organic matter made up mostly of kerogen, a high-molecular-weight solid or semi-solid substance that is insoluble in petroleum solvents and is essentially immobile in its rock matrix. Oil shale rivals coal as the world's most abundant form of hydrocarbon deposit. The presence of large oil shale deposits in the United States has stimulated much effort toward developing methods for recovering liquid and gaseous hydrocarbon products from oil shale.

Several such methods have been proposed which involve the direct application of heat to a subterranean oil shale formation. These methods are collectively known as in-situ retorting of oil shale. In-situ retorting of oil shale has been described in several patents, including U.S. Pat. Nos. 3,661,423; 4,043,595; 4,043,596; 4,043,597; 4,043,598; 4,091,869; and 4,263,970. U.S. Pat. No. 3,661,423, issued May 9, 1972 to Garret, discloses an in-situ retorting method which involves the steps of mining a void in a subterranean oil shale formation and fragmenting part of the formation near the void to form a defined volume known as a "retort" which contains a stationary, permeable mass of fragmented oil shale particles. The retort is surrounded by an unfragmented rock formation. Garret suggests that hot retorting gases be passed downward through the mass of fragmented oil shale particles to convert the kerogen contained therein into liquid and gaseous hydrocarbon products and other liquids and gases.

The process of Garret results in three zones in the subterranean retort: an upper combustion zone, a retort zone below the combustion zone, and a lower, cooler zone. Garret discloses the production of the hot retorting gases noted above by igniting the upper level of the retort using an initial supply of fuel and air to establish a combustion zone. In the combustion zone the kerogen-containing fragmented oil shale is retorted to produce liquid and gaseous hydrocarbons and oxygen is consumed by burning some of these produced hydrocarbons as well as by burning residual carbon in the retorted oil shale. Hot exhaust gases are produced as the result of the combustion and are used to retort the fragmented oil shale in a retort zone adjacent to and below the combustion zone. After the exhaust gases reach a sufficient temperature, the initial fuel supply is stopped and an oxygen source, such as air, introduced to allow the combustion zone to advance downward through the retort, driving ahead of itself the hot exhaust gases. In the retort zone, the hot exhaust gases decompose the kerogen into liquid and gaseous hydrocarbon products which flow downward and may be collected at the bottom of the retort.

U.S. Pat. No. 4,043,595, issued Aug. 23, 1977 to French, U.S. Pat. No. 4,043,596, issued Aug. 23, 1977 to Ridley, U.S. Pat. No. 4,043,597 issued Aug. 23, 1977 to French, and U.S. Pat. No. 4,043,598, issued Aug. 23, 1977 to French et al., disclose a variety of methods of forming an in-situ oil shale retort in which active retorting may be conducted in the manner disclosed in Garret.

During the active retorting step of in-situ retorting of oil shale, hot gases and liquids may escape to the surrounding rock formation through the rock matrix and fractures therein. Such leakage is aggravated when a series of in-situ retorts are created and hot gases and liquids escape from an active retort site to adjacent abandoned retorts as well as to the surrounding rock not yet retorted. Considerable amounts of heat and reaction products may escape from an active retort as the result of such leakage. Also, leakage of reaction products from an active in-situ retort may increase the difficulty and expense of sustaining retorting operations at a desired pressure. To reduce the amount of energy required to maintain a desired temperature in an active retort, and to reduce the difficulty and expense of maintaining a desired pressure in an active retort, it is important to minimize such loses.

Such hot escaping fluids typically include hazardous chemicals. Considerable contamination of the formation surrounding an active retort may result from such leakage of hazardous chemicals. Additionally, leakage of such hazardous reaction products, from an active retort through mine shafts or fractures may jeopardize the safety of mineworkers engaged in adjacent mining operations.

Current methods for reducing such heat loss, environmental contamination, and mineworker safety problems due to leakage include operating active retorts at low pressure, typically at just below atmospheric pressure, and increasing the spacing of a series of oil shale retorts conducted in a formation. Operation of an oil shale retort at low pressure may have the disadvantage of increasing the required diameter, and hence the expense of conduits needed to withdraw produced fluids out of a retort during active retorting. Increasing the spacing between retorts results in poor utilization of the oil shale resource.

U.S. Pat. No. 4,091,869, issued May 30, 1978 to Hoyer discloses a method of in-situ oil shale retorting in which a series of retorts are sequentially formed. After a first retort is formed, each succeeding retort is formed immediately laterally adjacent to an abandoned, or spent, retort in which active retorting has been completed. Hoyer recognizes that during active retorting, produced gases may leak to a permeable spent retort bordering the active retort. Hoyer proposes compacting the rubble in the spent retort and, either before or after so compacting the rubble, introducing sealing fluids into the rubble in the spent retort to reduce its permeability to the flow of gas. Hoyer suggests the use of aqueous solutions containing such additives as resins, silicates, or hydrated oxides as sealing fluids. Hoyer does not disclose any method for reducing fluid leakage at the interface between an active retort and a surrounding unfragmented rock formation. Hoyer does not acknowledge that a leakage problem may exist at such an interface. Rather, Hoyer characterizes as "impermeable" such surrounding unfragmented rock, though this characterization is not an accurate one for most formations.

It is an object of the present invention to minimize leakage of hot produced gases and liquids from an active in-situ oil shale retort to minimize heat loss and hence to reduce the amount of energy required to maintain the retort at a desired temperature. It is a further object of the present invention to maintain the pressure inside an active in-situ oil shale retort at a desired level to minimize the cost of equipment needed to sustain the retorting process and collect the produced fluids. It is also an object of the present invention to decrease the leakage of hazardous gases from an active in-situ oil retort to reduce contamination of the surrounding formation and to reduce the danger to mineworkers engaged in adjacent mining operations.

An additional benefit of the disclosed invention is that, by reducing hot fluid leakage from an active retort to one or more adjacent abandoned retorts, it allows a series of distinctly formed retorts to be more closely spaced than previously practical to increase the total recovery of shale oil from a given formation.

SUMMARY OF THE INVENTION

According to this invention, fluid is injected into the rock surrounding an in-situ oil shale retort at sufficient pressure and flow rate so that the injected fluid flows toward the retort to block the path of liquid and gaseous products of kerogen decomposition escaping from the retort to return heat to the retort and maintain the pressure therein. Preferably, a plurality of injection wells are drilled into the rock surrounding the retort and a noncombustible fluid is injected into the wells at sufficient pressure and flow rate so that the injected fluid flows toward the retort. It is preferred that liquid water be used as the injected fluid in practicing the present invention.

BRIEF DESCRIPTION OF THE DRAWINGS

These and other aspects of the present invention will be more fully understood when considered with the following description and the accompanying drawings.

FIG. 1 illustrates semi-schematically in vertical cross-section an in-situ oil shale retort and adjacent injection well operated in accordance with this invention.

FIG. 2 is a semi-schematic plan view of an active in situ oil shale retort surrounded by a plurality of injection wells operated in accordance with this invention.

DESCRIPTION OF THE PREFERRED EMBODIMENT

The present invention is a method for minimizing the energy required to maintain a desired temperature and pressure in an in-situ oil shale retort. In general, fluid is injected into the rock surrounding an in-situ oil shale retort at sufficient pressure and flow rate so that the injected fluid flows or has a tendency to flow toward the retort, blocking the path of hot liquids and gases escaping therefrom, returning heat to the retort maintaining the pressure therein.

FIG. 1 illustrates an in-situ oil shale retort 10 formed in a subterranean oil shale formation 9. Retort 10 contains a stationary, permeable mass 11 of fragmented oil shale particles. Such a retort is formed by mining a void in a subterranean oil shale formation and fragmenting part of the formation near the void, for example, by detonating explosives in the void, in such a way that the fragmented oil shale particles are distributed as a stationary, permeable mass throughout the retort volume. Methods of forming such an in-situ oil shale retort are described in detail in Garret and the other patents discussed above.

Retort 10 is bounded by unfragmented rock which is essentially intact but which may contain fractures 14. FIG. 1 also depicts an abandoned or spent in-situ oil shale retort 13 adjacent to retort 10. A desirable practice is to conduct an in-situ retorting operation in an oil shale formation by creating a series of distinct and separated in-situ retorts in that formation. This practice permits efficient extraction of the hydrocarbon from the formation. FIG. 1 depicts a portion of an oil shale formation being developed by such a series of retorting operations at a point in time when such retorting operations have been completed in retort 13 and are proceeding in retort 10.

One or more conduits 12 lead from the earth's surface to the top of the mass of fragmented oil shale particles 11. Conduit 12 facilitates introduction of a substance, such as air or other oxidizing gas, to support combustion in the retort.

Ignition of the fragmented permeable mass may be accomplished at the bottom of conduit 12 within the retort volume 10. A tunnel 30 is provided at the bottom of the retort for withdrawl of the gaseous products of kerogen decomposition according to methods well known in the art. A trough 31 is provided at the bottom of the retort, in the floor of tunnel 30, for withdrawl of the liquid products of kerogen decomposition according to sump pumping methods well known in the art.

To commence retorting, a heated zone is established in the retort, preferably at the top of the mass of fragmented oil shale particles. The temperature of the heated zone must be above the temperature at which kerogen decomposes into liquid and gaseous hydrocarbons and a solid charlike residue containing carbon. Any one of several methods well known in the art may be used to so establish the heated zone. For example, U.S. Pat. No. 4,263,970, issued Apr. 28, 1981 to Cha, describes in detail one such method for establishment of a heated zone which includes a combustion zone having temperature above the ignition temperature of the solid residue resulting from kerogen decomposition. FIG. 1 depicts such a combustion zone 16. Immediately below combustion zone 16 is heated retorting zone 17 in which kerogen decomposition occurs. Gases and liquids produced in retorting zone 17 flow down to collecting zone 18 where they may be collected.

After a heated zone is established, the heated zone is advanced through the retort and the produced liquid and gaseous kerogen decomposition products are collected.

A preferred method for advancing the heated zone is described in detail in Garret. There, the upper level of the fragmented mass of oil shale particles is ignited and a source of oxygen, such as air, is supplied to support continued combustion. The solid residue from kerogen decomposition serves as the primary fuel for combustion, though some liquid and gaseous kerogen decomposition products may also be burned in the region of combustion. The hot exhaust gases produced during combustion flow down through the retort and serve to decompose the kerogen contained in the fragmented oil shale particles to produce hot liquid and gaseous hydrocarbons and other hot liquids and gases. Much of the produced liquid and gas flows downward toward the bottom of the retort where it is collected. However, the increased pressure of the retort creates a tendency for some of the hot produced liquids and gases to leak horizontally into the rock surrounding the retort.

It has been found that kerogen will decompose into products, including a liquid hydrocarbon known as shale oil, at temperatures as low as 600° F. The time required to convert kerogen to shale oil is very sensitive to temperatures within the 600°–700° F. range Shale oil production rates may be enhanced by a factor of 15 to 20 by conducting oil shale retorting at 700° F. rather than at 600° F. Therefore, it is desirable to maintain a sufficiently high retorting temperature in the in-situ oil shale retort preferably in the region near 700° F.

Increasing the rate at which the heated zone of an in-situ oil shale retort is heated to a desired temperature enhances the yield of produced shale oil by reducing shale oil loss due to coking.

To reduce the amount of energy required to maintain an in-situ oil shale retort at a desired temperature and the rate at which energy needs to be added to raise the retort to such desired temperature at a desired heating rate, the heat loss from the retort via leakage of hot produced liquids and gases should be minimized. The rate of leakage of such produced fluids should also be minimized to reduce contamination of the formation surrounding an active retort due to hazardous chemicals contained in the produced fluids. Such leakage may result in considerable heat loss and contamination. Such heat loss is aggravated when a series of sequential in-situ retorts are conducted and hot gases escape from an active retort to an adjacent abandoned retort. The void left by the abandoned retort may enhance the leakage flow rate and provide storage for the escaping gases. The process of forming such a series of in-situ retorts typically involves the mining of portions of the oil shale formation. Typically, shafts (not shown in FIGS. 1 or 2) are mined which connect areas of the formation in which retorts will be formed. Such shafts, unless sealed off, provide fluid communication between active retorts and areas being mined. Leakage of hazardous gases from active retorts through such shafts or fractures connecting such shafts may jeopardize the safety of mineworkers engaged in adjacent mining operations.

According to the present invention, leakage of hot fluids from an active retort is controlled by injecting fluid into the rack surrounding an active retort. In a preferred embodiment of the present invention, the injected fluid is injected through one or more injection wells 15. The injection wells may be placed where convenient, around a single active retort, around a group of several active retorts, or between an active retort and an adjacent mining operation. The injected fluid has pressure and flow rate sufficient to cause some of the injected fluid to flow toward the retort to block the path of hot fluids escaping from the retort and return heat toward the retort.

FIG. 2 is a plan view of an active retort 10 around which a plurality of injection wells 15 have been drilled. Conduit 12 facilitates introduction of an oxygen-containing substance, such as air, to support combustion in the retort. Gaseous kerogen decomposition products are withdrawn through conduit 32. Liquid kerogen decomposition products are withdrawn through conduit 33 from trough 31 (not shown). Adjacent to retort 10 is an abandoned retort 13. Fractures 14 permeate the rock formation surrounding retorts 10 and 13. Some of the fractures 14 provide fluid communication between active retort 10 and abandoned retort 13. According to the present invention, fluid is injected into one or more of wells 15 at a pressure so that the injected fluid tends to flow toward retort 10, creating an obstacle in the path of hot fluids escaping from retort 10 through fractures 14 or through the rock surrounding retort 10.

In a preferred embodiment, water is used as an injected fluid. At the interface between the injected water and escaping hot fluids whose path is blocked by the injected water, heat will flow from the escaping fluid to the injected water, in some cases, transforming a portion of the injected water into steam. By increasing the well injection rates the hot water or steam can be moved toward the retort, thus returning heat to the retort. Introduction of steam to an active in-situ oil shale retort is known to increase the yield of retort products under certain conditions. Thus, use of water as an injected fluid may reduce the amount of steam required to be directly injected into an active retort to obtain a desired yield.

Most intact oil shale formations have very low permeability. However, where a series of sequential in-situ retorts are conducted, the step of forming each retort typically involves an explosion in the subterranean formation and creates or enhances fractures 14 in the formation. Such fracturing not only increases the fluid leakage problem addressed by the present invention, but also enhances the effectiveness of the present solution to that problem by increasing the flow rate of the injected fluid toward the retort.

When retorting operations have been completed in retort 10, and retort 10 is abandoned, injection wells 15 drilled for use in practicing the present invention may desirably be used for insertion of explosives, or related purposes, as part of the process of forming new in-situ retorts adjacent to retort 10.

In a desired embodiment of the present invention, hot combustion or reaction gas containing carbon dioxide is collected from an active in-situ retort and injected through injection wells 15. The high temperature of the injected combustion or reaction gas would enhance the effectiveness of the invention in minimizing heat loss from active retort 10.

In another desired embodiment of the present invention, the injected fluids are preheated, as by heat exchange with the produced hot liquid and gaseous kerogen decomposition products collected from an active retort. Such heat exchange step may be accomplished by methods well known in the art either on or beneath the surface of the earth near the active retort.

It is preferred that noncombustible fluid be injected during practice of the present invention to eliminate the risk of explosion when the injected fluid is heated by contact with hot fluids in or escaping from the active retort.

The above description of a method for injecting fluid into the rock surrounding an in-situ oil shale retort at sufficient pressure and flow rate to flow toward the retort is for illustrative purposes. Because variations of the invention will be apparent to those skilled in the art, the present invention is not intended to be limited to the particular embodiments described above.

We claim:

1. A method for in-situ retorting of oil comprising:

(a) heating kerogen-containing oil shale in a subterranean retort to decompose the kerogen to produce hot liquid and gaseous decomposition products and a solid residue; and (b) injecting substantially only water into the subterranean formation surrounding the retort at a sufficient pressure and flow rate so that a portion of the injected water lessens the amount of hot liquid and gaseous kerogen decomposition products escaping from the retort and flows toward the retort thereby returning heat to the retort.

2. A method for in-situ retorting of oil shale comprising:

(a) fragmenting a subterranean formation of kerogen-containing oil shale to form a retort containing a mass of fragmented oil shale and surrounded by unfragmented rock;

(b) establishing in the retort a heated zone of sufficiently high temperature to decompose the kerogen in the region of the heated zone to produce hot liquid and gaseous kerogen decomposition products and a carbon-containing solid residue;

(c) advancing the heated zone through the retort;

(d) collecting the produced liquids and gases; and (e) injecting substantially only water into the rock surrounding the retort at a sufficient pressure and flow rate so that a portion of the injected water lessens the amount of hot liquid and gaseous kerogen decomposition products escaping from the retort and flows toward the retort thereby returning heat to the retort.

3. A method for in-situ retorting of oil shale comprising:

(a) fragmenting a subterranean formation of kerogen-containing oil shale to form a retort containing a mass of fragmented oil shale and surrounded by unfragmented rock;

(b) establishing in the retort a heated zone of sufficiently high temperature to decompose the kerogen to produce hot liquid and gaseous kerogen decomposition products and a carbon-containing solid residue;

(c) advancing the heated zone through the retort;

(d) collecting the produced liquids and gases;

(e) drilling a plurality of injection wells into the rock surrounding the retort; and (f) injecting substantially only water through the injection wells into the rock surrounding the retort at a sufficient pressure and flow rate so that a portion of said injected water lessens the amount of hot liquid and gaseous kerogen decomposition products escaping from the retort and flows toward the retort thereby returning heat to the retort.

* * * * *